US005133202A

United States Patent [19]

Grant

[11] Patent Number: 5,133,202

[45] Date of Patent: Jul. 28, 1992

[54] DISK TUMBLER LOCK DECODER

[76] Inventor: Maurice Grant, 11390 N 209 E. Ave., Claremore, Okla. 74017

[21] Appl. No.: 703,195

[22] Filed: May 20, 1991

[51] Int. Cl.[5] ..... E05B 19/20

[52] U.S. Cl. ..... 70/278; 307/10.1; 70/394; 70/409; 70/413; 33/540

[58] Field of Search ..... 70/394, 395, 398, 277, 70/278, 407, 409, 413; 33/539, 540; 235/361, 382, 492; 200/46; 340/825.31; 379/140; 307/10.1 X

[56] References Cited

U.S. PATENT DOCUMENTS

| | | | |
|---|---|---|---|
| 2,087,423 | 7/1937 | Abrams | 33/174 |
| 2,338,768 | 1/1944 | Johnstone | 70/394 |
| 3,264,742 | 8/1966 | Roland | 33/174 |
| 3,347,072 | 10/1967 | Rose | 70/277 |
| 3,827,151 | 8/1974 | Naill | 33/174 |
| 3,987,654 | 10/1976 | Iaccino | 70/394 |
| 4,192,400 | 3/1980 | McEwan | 180/287 |
| 4,229,959 | 10/1980 | Easley | 70/394 |
| 4,680,870 | 7/1987 | McConnell | 33/540 |

OTHER PUBLICATIONS

"The Latest About VATS", Bill Phillips, Mar. 1990, pp. 12–14, Keynotes.

"VATS Update", Shirl Schamp, Mar. 1990 National Locksmith pp. 62–63.

*Primary Examiner*—Renee S. Luebke
*Assistant Examiner*—D. M. Boucher
*Attorney, Agent, or Firm*—Head & Johnson

[57] ABSTRACT

A decoder is provided for disk tumble locks which is electrically rather than mechanically operated. A plurality of separate keys each has a blade sufficiently long to extend through all of the disks in the lock. At least one cut is provided in the blade of each key. The depth of the cut in each key is different, the cut of each key being coordinated to a different depth of disk from among the known alternative disk depths for the given tuumbler lock to be decoded. The base surface of each cut contains discrete electrical contact connected by a discrete conductor to a point on the key which is externally accessible when the key is fully inserted into the lock. Each contact is positioned on its key so that, when the key is inserted into the lock keyway, an electrically conductive circuit is completed by the disk if the depth of the disk corresponds to or exceeds the depth of the cut. By alignment of the contact with a disk, a discrete electrical circuit will extend from the externally accessible positive point on the key when the contact is aligned with a disk of appropriate depth. If keys are sequentially inserted into the keyway, beginning with the key of deepest cut and gradually progressing toward the key of shallowest cut, the key first completing the electrical circuit associated with any disk will complete a circuit indicating the depth of that disk, thus decoding the lock.

18 Claims, 3 Drawing Sheets

DISK TUMBLER LOCK DECODER

BACKGROUND OF THE INVENTION

This invention relates generally to high security locks and more particularly concerns disk tumbler locks.

Disk tumbler locks are used in a wide variety of applications. For example, most door, trunk and glove compartment locks on motor vehicles are disk tumbler locks. Once a disk tumbler lock is installed, it is desirable to have the ability to cut a key having the appropriate combination to open the lock without having to remove the lock from its mounting. Such removal is time consuming and could cause damage to the locked article as well as to the lock.

Consequently, various types of decoders have been devised for determining the combination of disk tumbler locks. Most are apparats which mechanically measure disk dimensions to determine the combinations. However, mechanical measurement of the disks and transfer of the measured information to the user is a complicated, time consuming and often inaccurate process. A relatively complex mechanism inserted into the keyway must be manipulated to the trained feel or touch of an accomplished locksmith. The information gained must then be converted to externally readable data, generally accomplished by increased complexity of the equipment or further subjective assessment by the locksmith. Generally each disk requires a separate manipulation making the decoding process a lengthy and inaccurate procedure.

It is, therefore, an object of this invention to provide a disk tumbler lock decoder that is easy to use, regardless of the degree of dexterity or "feel" of the locksmith. A further object of this invention is to provide a disk tumbler lock decoder that has no moving parts.

SUMMARY OF THE INVENTION

In accordance with the invention, a decoder is provided for disk tumbler locks which is electrically rather than mechanically operated. A plurality of separate keys each has a blade sufficiently long to extend through all of the disks in the lock. At least one cut is provided in the blade of each key. The depth of the cut in each key is different, the cut of each key being coordinated to a different depth of disk from among the known alternative disk depths for the given tumbler lock to be decoded. The base surface of each cut contains an electrical contact connected by a discrete conductor to a point on the key which is externally accessible when the key is fully inserted into the lock. The key also includes a ground conductor which makes electrically conductive connection with the lock housing or cylinder when the key is inserted into the keyway and extends to another point on the key externally accessible when the key is fully inserted into the lock. Each contact is positioned on its key so that, when the key is inserted into the lock keyway, an electrically conductive circuit is completed by the disk if the depth of the disk corresponds to or exceeds the depth of the cut. By alignment of the contact with a disk, a discrete electrical circuit will extend from the externally accessible positive point on the key to the externally accessible ground point on the key when the contact is aligned with a disk of appropriate depth. If keys are sequentially inserted into the keyway, beginning with the key of deepest cut and gradually progressing toward the key of shallowest cut, the key first completing the electrical circuit associated with any disk will complete a circuit indicating the depth of that disk, thus decoding the lock.

In one embodiment of the invention, given, for example, a lock to be decoded having eight tumblers of four different depths, three keys, each having a cut in the leading end with the cuts varying from the deepest cut to the third deepest cut, could be used to decode the lock by inserting the deepest cut key into the lock and sequentially aligning the cut with each of the disks. This results in the completion of circuits to determine which of the disks had a depth corresponding to the deepest cut key. Repeating the process with the next deepest cut key, the circuits completed by this key, other than those completed by the previous key, indicate which disks were at the next deepest depth. This procedure need only be repeated for one less number of keys than possible depths, the disks not contacted by any of the keys being those which are of the shallowest cut.

In one preferred embodiment of the invention, each key is provided with a plurality of cuts of the same depth, at least one for alignment with each disk in the lock. Each cut has its own discrete contact and circuit to a separate externally accessible point on the key, so that all disks corresponding to the particular depth of that key could be determined by a single insertion of the key into the keyway.

Preferably, the external contact points of the keys will be matable with an external identifying circuit. The identifying circuit connects each completed disk circuit to a control circuit which in turn sequentially operates a plurality of indicating circuits to provide a visible display of the lock combination. Such a display preferably includes a plurality of LED's which display the identifying number associated with each incrementally graduated depth of disk in the lock.

Of course, many variations are possible. The contacts could be replaced by bubble switches operated by the pressure of a contacted disk, eliminating the need for electrically conductive disks. The keys could be flat rather than cut, provided the necessary contact or bubble switch positions are maintained.

In any event, the operation of the electrical rather than mechanical device requires only the sequential insertion of the keys into the lock and connecting of the external access points on the keys to the identifying circuit input terminals. No special dexterity or "feel" is required. No moving parts complicate the device or its operation. No special training or experience is necessary to decipher the combination. One need merely read the numbers displayed by the identifying circuit to know the combination of the lock.

BRIEF DESCRIPTION OF THE DRAWINGS

Other objects and advantages of the invention Will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
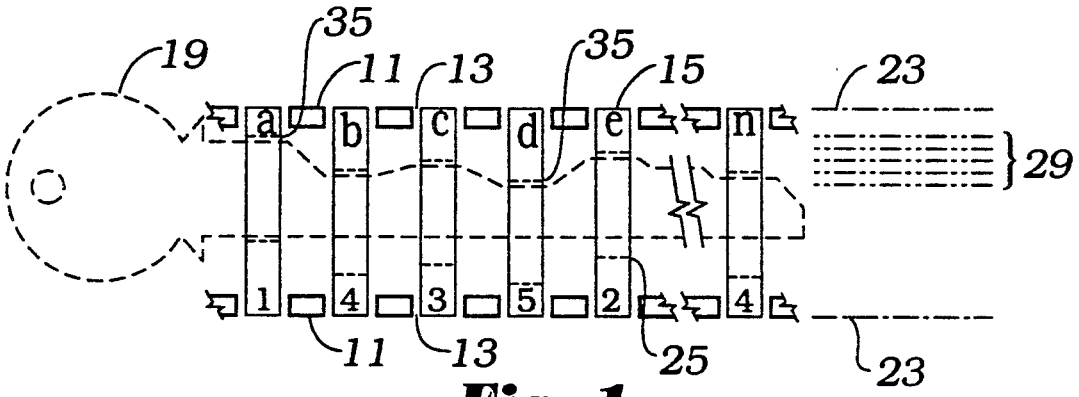
FIG. 1 is a cross sectional view illustrating the open position of a disk tumbler lock having "n" tumblers and "x" disk depths, a properly coded key being inserted in the keyway of the lock.
Figure 2:
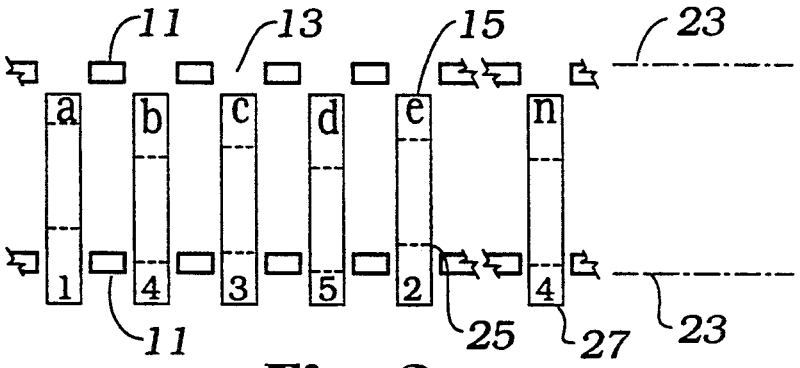
FIG. 2 is a cross-sectional view of the disk tumbler lock of FIG. 1 in a locked condition with the key removed, the disks extending beyond the periphery of the lock cylinder.
Figure 3:
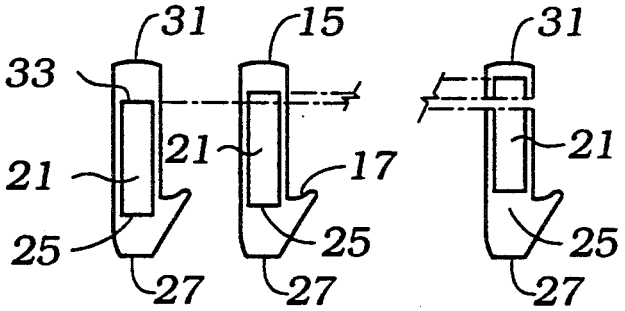
FIG. 3 is a front elevational view of several disks illustrating the incremental depth relationship of the disks of the disk tumbler lock.

The pertinent components of a typical disk tumbler lock are illustrated in FIGS. 1, 2 and 3. They include the lock cylinder 11 which has a plurality of spaces 13 through its top and bottom portions in which a plurality of disks 15 are mounted. As shown in FIG. 3, each of the disks 15 has a shoulder 17 which, in cooperation with a biasing spring (not shown), urges the disk toward a downward locked condition. The lock cylinder 11 rotates within a housing (not shown). As shown in FIG. 1, when an appropriately coded key 19 is inserted through slots 21 in the disks 15, the disks 15 are forced upwardly against the bias of the spring and maintained in a position which aligns the top and bottom portions of the disks 15 with the outer edges of the cylinder 11. Thus, the cylinder 11 and the disks 15 may be rotated within the interior surfaces 23 of the housing.

As shown in FIG. 1, the disk tumbler lock consists of a plurality of disks numbered "a" through "n", with typical locks having six to thirteen such disks 15. As shown, the disk slots 21 are all of equal depth defined between a bottom portion 25 above the bottom 27 of the disks 15 and a top portion 33 below the top 31 of the disks 15. However, the slots 21 are disposed at different incremental depths, as illustrated by axes 29 in FIGS. 1 and 3. As shown, the disks 15 are generally grouped and numerically identified in the trade according to the distance from the top 31 of the disks 15 to the top 33 of the slot 21. The disks 15 having the shallowest depth from the top 31 of the disk 15 to the top 33 of the slot 21 are generally identified as combination code "1" disks, with disks 15 with sequentially deeper slots being identified as combination code "2" through "x". Typical disk tumbler locks have from three to six incrementally graduated groups of disks or combination codes, though any number "x" could be employed. As illustrated in FIG. 1, an appropriately coded key 19 has a plurality of cuts 35, one corresponding to the depth of each of its disk slot tops 33 so that, when the key 19 is fully inserted in the lock, each of the tops 33 of the slots 21 rides on its respective cut 35, thus properly aligning all of the disks 15 within the interior walls 23 of the housing and permitting the cylinder 11 and disks 15 to be rotated.

As shown in FIG. 2, when the key 19 has been removed, the spring bias against the shoulders 17 of the disks 15 forces the disks 15 to a downward position such that the bottoms 27 of the disks 15 extend into a groove (not shown) in the interior surface 23 of the housing so that the disks 15 extend beneath the cylinder 11 and the interior wall 23 of the housing. Thus, the lock is in its "lock" position. In this "lock" position, the disks 15 engage with the housing groove (not shown), preventing rotation of the cylinder. With reference to the lock in the "lock" position as shown in FIG. 2, the decoder can now be described and understood.

Figure 4:
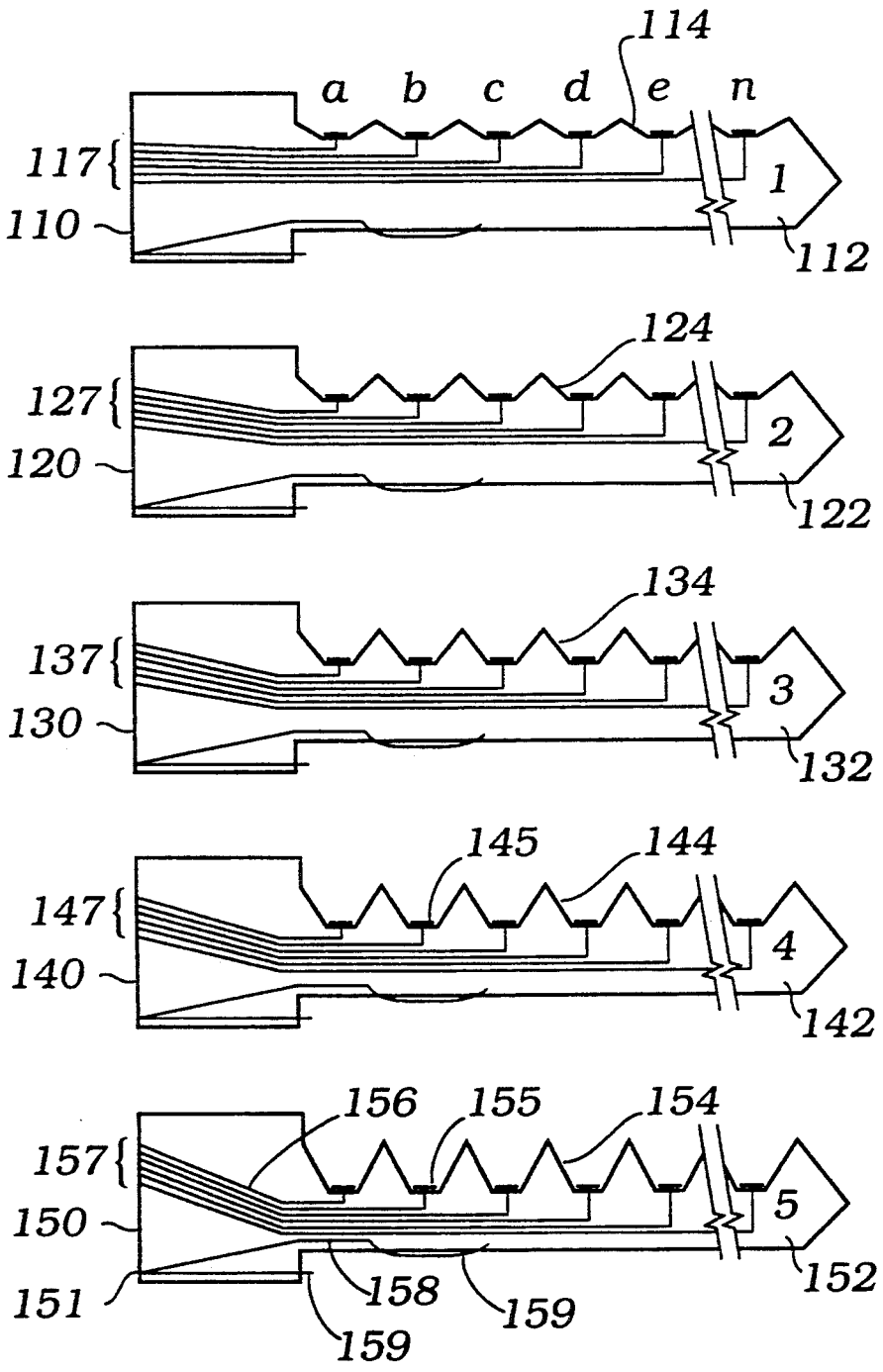
FIG. 4 is a side elevational view of a preferred embodiment of the invention, including a plurality of reader keys for decoding a disk tumbler lock such as the lock illustrated in FIG. 1.

Turning to FIG. 4, five reader keys 110, 120, 130, 140 and 150 are illustrated, each of which respectively corresponds to the combination code groups 1, 2, 3, 4 and 5 from which the disks 15 illustrated in FIG. 2 were selected. Each of the reader keys has a blade 112, 122, 132, 142 and 152 having a plurality of segments a through n corresponding to the disks a through n as illustrated in FIG. 2. In the preferred embodiment shown, each of the key segments is provided with a plurality of cuts 114, 124, 134, 144 and 154. The cuts on each of the keys are sequentially incrementally deeper in correspondence to the difference in incremental depth of the slots 21 of the disks 15 as illustrated in FIG. 2. Thus, all of the cuts 114 in the reader key 110 are cut to a depth corresponding to the depth of the slot 21 of the disk a of FIG. 2, which is the shallowest of the disk slot depths. Similarly, the depth of the cuts 124 of the key 120 correspond to the depth of the slot 21 in the disk e as shown in FIG. 2. The depth of the cuts in each of the keys become progressively deeper until the cuts 154 of key 150 are the deepest cuts, corresponding to the deepest cut slots 21 of the disk d in FIG. 2. Thus, if the key 150 having the deepest cuts 154 were inserted into the keyway of the lock illustrated in FIG. 2, it will be readily apparent that only the slot tops 33 for disks having a depth of combination code 5 will extend to a depth sufficient to make contact with the base of the cut 154 of the key 150. That is, when the combination code 5 key is inserted into the lock, the combination code 5 disk d will make contact with the base of its respective cut 154 while the other disks a, b, c, e and n will not reach the base of their respective cuts 154.

As shown in the preferred embodiment of FIG. 4, each of the cuts 15 has at its base an electrical contact 155 connected by a discrete conductor 156 to an external contact point 157. Thus, if disks 15 are electrically conductive, connection of any of the disks 15 with any of the contacts 155 provides a discrete electrical circuit from the disk 15 through the external connection point 157. This circuit can further be extended by a discrete ground conductor 158 having an exposed portion 159 for contact with the lock cylinder 11 or housing and an ground point 151 which is exteriorly accessible when the key 150 is fully inserted into the lock. Thus, it can be seen that, upon insertion of the key 150 into the lock illustrated in FIG. 2, a discrete circuit extending from the positive point 157 associated with the segment d of the key to the ground point 151 will be usable to identify the disk d in the lock as a combination code 5 disk.

Key 140 being the key of second deepest cuts 144, corresponding in depth to the disks b and n of the lock of FIGURE 2, can next be inserted into the keyway. It will be readily apparent that upon insertion of the key 140, electrical connection will be made between the contacts 145 and any disks 15 having a slot top 33 of depth equal to or greater than the depth of the combination code 4 disks. That is, upon insertion of the key 140, the disks b, d and n of FIG. 2 will make electrical connection with the contacts 145 of segments b, d and n of the key 140. Since disk d will already have been identified as a combination code 5 disk, the completion of the circuits through the disks will indicate that the disks b and n are combination code 4 disks. The process can then be repeated with key 130, being the key of third deepest cuts 134 which will be found to correspond to the depths of the disks c shown in FIG. 2. Similarly, insertion of the key 120 will likewise disclose that disk e is a combination code 2 disk. By elimination, therefor, disk a must be a combination code 1 disk, a fact which may be confirmed, if desired, by the use of an additional reader key 110 which is the key having cuts corresponding to the shallowest disks.

Figure 5:
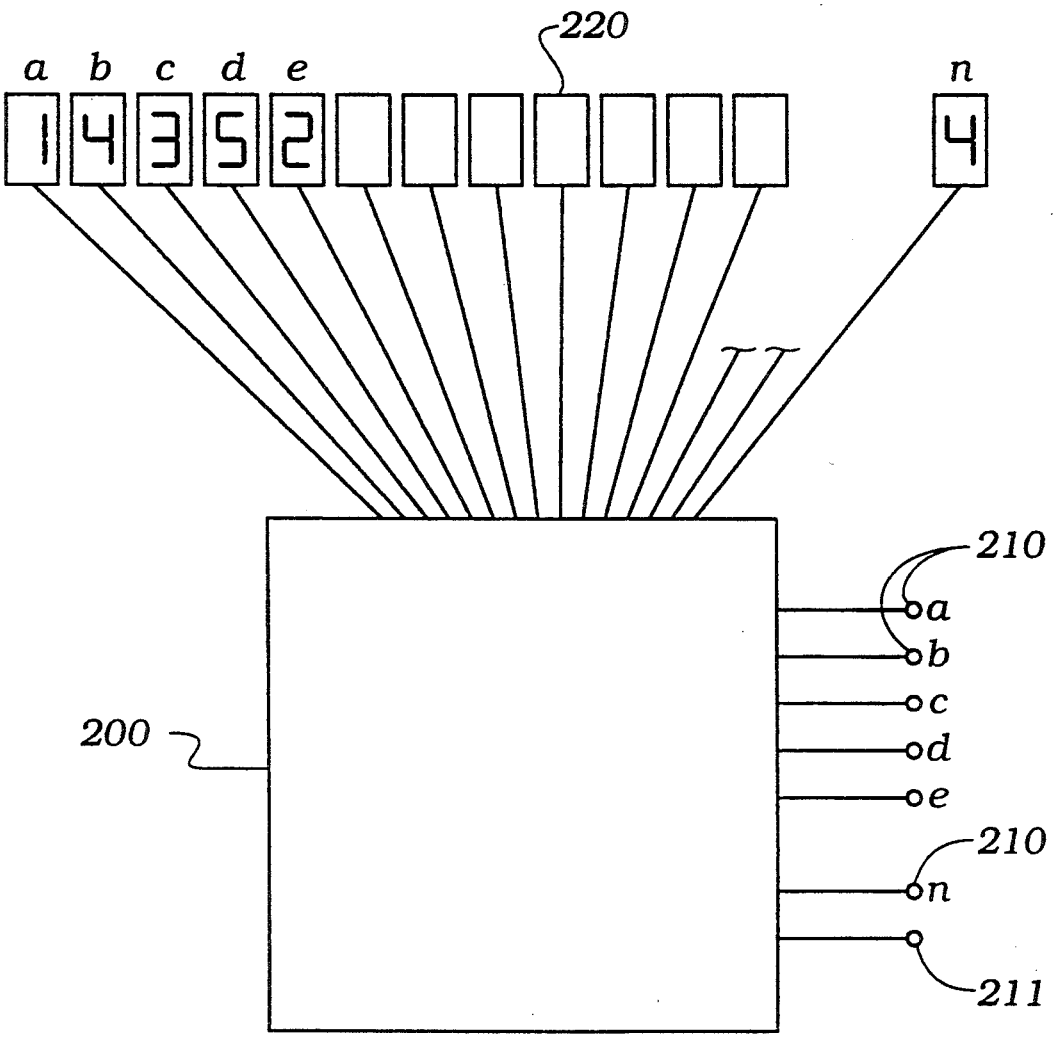
FIG. 5 is a block diagram of the display circuitry for visible indication of the combination of the lock sensed by the reader keys of FIG. 4.

Turning now to FIG. 5, an indicator circuit 200 for use with the reader keys illustrated in FIG. 4 includes a plurality of input terminals 210 identified as a through n, which correspond to the positive external contact points 117, 127, 137, 147 and 157 of the reader keys and therefore to the respective segments a through n of the keys and a ground terminal 211 for connection to the external ground point on the reader keys. The output of the circuit 200 is connected to a plurality of LED's 220 for numerical display of the combination of the lock being decoded. In a typical arrangement, the circuit might include as many as 15 LED's 220 and as many as 15 input terminals 210. There are many ways of connecting such circuits well known in the art. Preferably, the circuit employed will include blocking devices such that, during the sequential application of a given set of reader keys, once energized, an LED will maintain its display until all of the LED's necessary to decode the combination of the lock have been energized.

As earlier mentioned, many variations of the decoder are possible. For example, a contact may be provided on only the leading segment 'n' of each of the keys so that a key may be slowly inserted into or withdrawn from the keyway to provide a sequential indication of which circuits are completed as the key is withdrawn or inserted. It will also be readily apparent that the key need not necessarily have cuts at all, but that the blade surface may be flat with the blade surface of each of the keys being at a depth corresponding to one of the depths of the groups of disks of the lock to be decoded. Furthermore, multiple arrangements of contacts can be provided on a single key with the contacts staggered or stepped on the cuts or side surfaces of the key at appropriate depths to identify the combination code of a disk with a single reader key. Furthermore, as has already been pointed out, the electrical contacts can be replaced by bubble switches or the like, such that the force exerted on the switch completes a discrete circuit within the key without reliance on conductivity of the disk or any lock element. The keys themselves can be of conductive material with insulated wires embedded in the material or the keys can be made of a nonconductive material with bare conductive wires discretely disposed within the key material.

Thus, it is apparent that there has been provided, in accordance with the invention, a disk tumbler lock decoder that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For disk tumbler locks having an array of 'n' disks randomly selected from 'x' groups of disks sorted according to a graduated scale of 'x' disk depths, each disk of the array being spring loaded in a cylinder for rotation within a housing from a lock position to an open position when the array of disks is cylindrically aligned with the lock cylinder by insertion therein of a properly coded key, a decoder comprising at least one reader means having at least 'n' segments, one said segment for alignment with each one of the disks when said reader means is inserted in the lock, at least a leading one of said segments having at least one electrically discrete contact means disposed thereon at a depth corresponding to at least one predetermined depth of the 'x' randomly selectable graduated depths which completes a discrete electrically conductive circuit when the graduated depth of its respective one of said disks corresponds to or exceeds the depth of said contact means.

2. For disk tumbler locks having an array of 'n' disks randomly selected from 'x' groups of disks sorted according to a graduated scale of 'x' disk depths, each disk of the array being spring loaded in a cylinder for rotation within a housing from a lock position to an open position when the array of disks is cylindrically aligned with the lock cylinder by insertion therein of a properly coded key, a decoder one contact means disposed thereon comprising 'x−1' reader means having at least 'n' segments, one said segment for alignment with each one of the disks when said reader means is inserted in the lock, each said reader means having one contact means on each said segment at a depth corresponding to at least one predetermined depth of the 'x' randomly selectable graduated depths, all said contact means on any one of said reader means being disposed at the same depth and each said reader means having its said contact means disposed at a different depth than the others of said reader means not including the least of said depths, said contact means for completing a discrete electrically conductive circuit when the graduated depth of its respective one of said disks corresponds to or exceeds the depth of said contact means.

3. A decoder according to claim 2 further comprising an electrically actuated means responsive to electrically conductive operation of said contact means for identifying the group of disks to which each of the disks belongs.

4. A decoder according to claim 3, said actuated means having at least 'n' indicating means, each indicating means sequentially corresponding to a respectively sequential one of the disks and said segments of said reader means.

5. For disk tumbler locks having an array of 'n' disks randomly selected from 'x' groups of disks sorted according to a graduated scale of 'x' disks depths, each disk of the array being spring loaded in a cylinder for rotation within a housing from a lock position to an open position when the array of disks is cylindrically aligned with the lock cylinder by insertion therein of a properly coded key, a decoder comprising at least one reader key having at least 'n' segments, one said segment for alignment with each one of the disks when said key is inserted in the lock, at least a leading one of said segments having a cut disposed therein to a depth corresponding to one of the predetermined depths of the 'x' randomly selectable graduated depths, all of said cuts on any one of said reader keys being to the same depth, each of said cuts having an electrically discrete contact means disposed thereon which completes a discrete electrically conductive connection circuit when the graduated depth of its respective one of said disks corresponds to or exceeds the depth of said contact means.

6. For disk tumbler locks having an array of 'n' disks randomly selected from 'x' groups of disks sorted according to a graduated scale of 'x' disks depths, each disk of the array being spring loaded in a cylinder for rotation within a housing from a lock position to an open position when the array of disks is cylindrically aligned with the lock cylinder by insertion therein of a properly coded key, a decoder comprising at least one reader key having at least 'n' segments, one said segment for alignment with each one of the disks when said key is inserted in the lock, at least a leading one of said segments having a cut disposed therein to a depth corresponding to one of the predetermined depths of the 'x' randomly selectable graduated depths, all of said cuts on any one of said reader keys being to the same depth, each of said cuts having a discrete electrical contact disposed on an upper surface of its respective cut and a discrete and insulated conducting means extending from said contact to a remote electrically accessible point on said key for completing a discrete electrically conductive connection circuit when the graduated depth of its respective one of said disks corresponds to or exceeds the depth of said contact means.

7. A decoder according to claim 6 comprising 'x-1' reader keys, each said key having its said cuts disposed at a different depth than the others of said keys not including the least of said depths.

8. A decoder according to claim 7 further comprising an electrically actuated means responsive to electrically conductive operation of said contacts for identifying the group of disks to which each of the disks belongs.

9. A decoder according to claim 8, said actuated means having at least 'n' indicating means, each indicating means sequentially corresponding to a respectively sequential one of the disk and said key segments.

10. A decoder according to claim 9, said actuated means having at least 'x-1' input terminals, each said input terminal having at least 'n' discrete input jacks, one jack for connection to each said remote position of one of said keys.

11. A decoder according to claim 10, said actuated means further comprising logic circuitry interconnecting each of said sequential indicating means to respective ones of said discrete jacks of said input terminals whereby, as each of said keys is sequentially inserted in the lock beginning with the key having the deepest cuts and ending with the key having the shallowest cuts, said indicating means display the group to which their respective disks belong.

12. A decoder according to claim 11, said indicating means providing a visual display.

13. For disk tumbler locks having an array of 'n' electrically conductive disks randomly selected from 'x' groups of disks sorted according to a graduated scale of 'x' disk depths, each disk of the array being spring loaded in a cylinder for rotation within a housing from a lock position to an open position when the array of disks is cylindrically aligned with the lock cylinder by insertion therein of a properly coded key, a decoder comprising at least one reader key having at least 'n' segments, one said segment for alignment with each one of the disks, each of said segments having a cut disposed therein to a depth corresponding to one of the predetermined depths of the 'x' randomly selectable graduated depths, all of said cuts being to the same depth, each of said cuts having a discrete electrical contact disposed on an upper surface of its respective cut for discrete electrically conductive connection with its respective one of said disks if the graduated depth of its respective one of said disks corresponds to or exceeds the depth of said cut, each said contact having an insulated conductor extending therefrom to a remote electrically accessible point on said key.

14. A decoder according to claim 13 comprising 'x−1' reader keys, each said key having its said cuts disposed at a different depth than the others of said keys not including the least of said depths.

15. A decoder according to claim 14 further comprising a display circuit having at least 'x−1' input terminals, at least 'n' indicating means and logic circuitry, each said input terminal having at least 'n' discrete input jacks, one jack for connection to each said remote point of one of said keys, each indicating means sequentially corresponding to a respectively sequential one of the disks and said key segments, said logic circuitry interconnecting each of said sequential indicating means to respective ones of said discrete jacks of said input terminals whereby, as each of said keys is sequentially inserted in the lock beginning with the key having the deepest cuts and ending with the key having the shallowest cuts, said indicating means display the group to which their respective disks belong.

16. A decoder according to claim 15, said indicating means providing a visual display.

17. A decoder according to claim 16, each of said keys comprising an integral body of electrically insulating material having said conductors discretely disposed therein.

18. A decoder according to claim 17, each of said keys further comprising a ground conductor discretely disposed therein and extending from a contact disposed on said key for electrically conductive connection to the housing or cylinder of the lock when said key is inserted in the lock to a remote ground point disposed on said key for connection with a ground jack of said display circuit.

* * * * *